US006868821B2

(12) United States Patent
Maier et al.

(10) Patent No.: US 6,868,821 B2
(45) Date of Patent: Mar. 22, 2005

(54) FAN ARRANGEMENT

(75) Inventors: Georg Maier, Kernen (DE); Fritz Kiesewetter, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/671,663

(22) Filed: Sep. 29, 2003

(65) Prior Publication Data

US 2004/0060525 A1 Apr. 1, 2004

(30) Foreign Application Priority Data

Sep. 28, 2002 (DE) ..... 102 45 418

(51) Int. Cl.[7] ..... F02B 77/00

(52) U.S. Cl. ..... 123/198 E; 55/438; 55/473; 55/DIG. 14; 55/DIG. 28

(58) Field of Search ..... 123/41.56, 41.65, 123/41.7, 198 E; 55/438, 473

(56) References Cited

U.S. PATENT DOCUMENTS 5,438,965 A * 8/1995 Aronsson et al. ..... 123/198 E 5,720,243 A * 2/1998 Stegemyr et al. ..... 123/198 E

FOREIGN PATENT DOCUMENTS

DE 36 04 166 3/1986

* cited by examiner

*Primary Examiner*—Noah P. Kamen
(74) *Attorney, Agent, or Firm*—Walter Ottesen

(57) ABSTRACT

A fan arrangement of an internal combustion engine, especially of a portable handheld work apparatus, includes a fan wheel (5) and a spirally-shaped fan housing at least partially enclosing the fan wheel. A take-out opening (13) is provided in the fan arrangement at the region of the moved air flow for diverting a combustion air flow for the engine. The combustion air flow is branched-off from the air flow. The take-out opening (13) is arranged in radial direction directly outside of the fan wheel (5) and is so configured that the take-out opening (13) defines a window (14) which, referred to the flow direction (S), has a small width at a forward edge and that the width as well as the depth of the window (14) increases to a rearward edge.

16 Claims, 4 Drawing Sheets

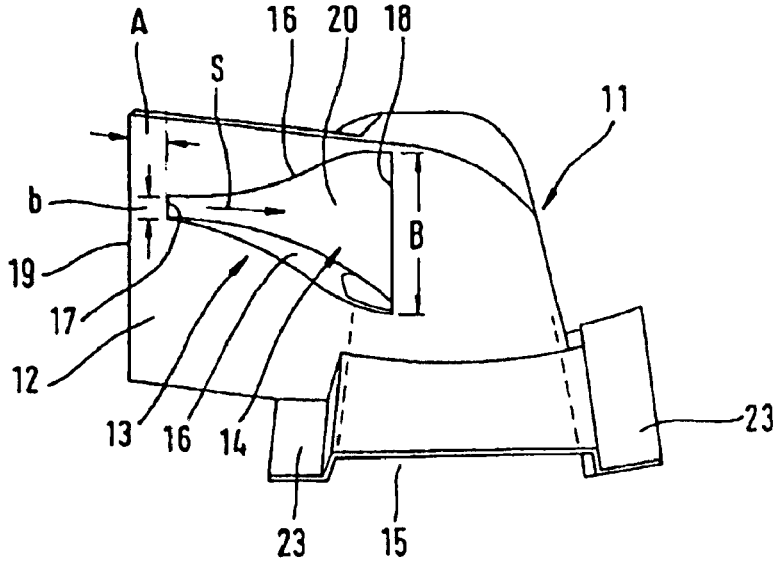
Fig. 3
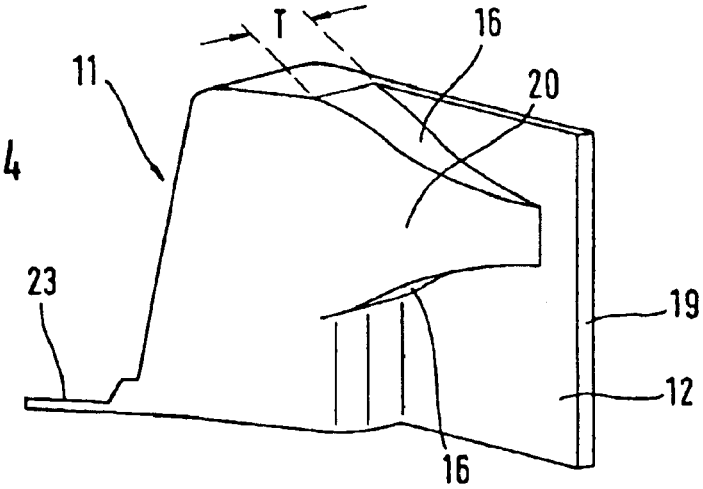
Fig. 4
Fig. 5
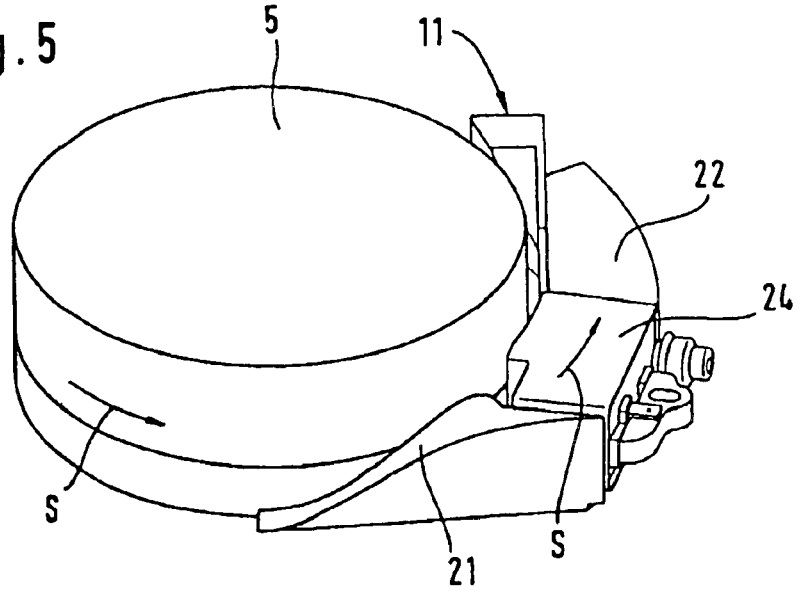

FAN ARRANGEMENT

BACKGROUND OF THE INVENTION

Portable handheld work apparatus, which are driven by an internal combustion engine, have a radial fan for cooling the engine in known embodiments. Such work apparatus include chain saws, brushcutters, suction and blower apparatus or the like. The radial fan arrangement includes a fan wheel and a spirally-shaped fan housing which at least partially encloses the fan wheel. The fan wheel is attached to the crankshaft of the engine and rotates with the crankshaft at the same rpm.

U.S. Pat. No. 4,716,860 discloses a fan arrangement wherein a take-out opening is provided in the region of the moved air flow for diverting a combustion air flow for the engine. The combustion air flow is branched off of the air flow moved by the fan arrangement. The take-out opening is disposed in such a manner that, because of the centrifugal force, the dirt particles are moved with the air flow component which is used as the cooling air flow component for the engine and that the air flow component, which is supplied to the carburetor, is substantially freed of the dirt particles.

To increase the power of internal combustion engines in portable handheld work apparatus, it has already been suggested to increase the air pressure of the combustion air flow. Here, the back pressure of the cooling air flow is used in order to supply the branched-off combustion air flow with overpressure through a combustion air channel to the carburetor. Dirt particles are supplied with the inducted air flow during operation of a drive in a work apparatus under corresponding ambient conditions. These dirt particles are transported within the cooling fan assembly together with the air flow which is to be moved.

Various embodiments of preseparators are known which function to keep the entrained particles away from the take-out opening for the combustion air flow. The effect of such preseparators is dependent upon the position and the flow conditions and is therefore not always satisfactory. For insufficient separation, a high load is imposed on the air filter mounted upstream of the carburetor and has the consequence that frequent cleanings are needed or corresponding filter exchanges are made.

SUMMARY OF THE INVENTION

It is an object of the invention to provide a fan arrangement of the kind described above wherein an increased air quantity can be diverted as combustion air in a small space.

The fan arrangement of the invention is for an internal combustion engine including an engine of a portable handheld work apparatus. The fan arrangement includes: a fan wheel for acting on air to move the air in an air flow defining a flow direction (S); a fan housing at least partially surrounding the fan wheel; a take-out opening disposed in the region of the air flow to branch off a component of the air flow as a combustion air flow for the internal combustion engine; the take-out opening being disposed outside of the fan wheel in radial direction; the take-out opening being configured as a window having a forward edge viewed in the flow direction (S) and the forward edge having a small width (b); and, the window having a rearward edge and the window having a width and a depth which both increase toward the rearward edge.

With the invention, a special inlet geometry of the separator is provided wherein the window is narrow at the beginning and becomes wider and deeper in flow direction and, for the same end cross section, moves more air into the separator than in known arrangements.

In a practical arrangement, the window is delimited by two ramps diverging in flow direction. An especially advantageous embodiment is that the ramps are in the form of a double arc. The window is configured in a housing element next to the fan wheel and is mounted on the side of the housing element facing away from the fan wheel. This side of the housing element is preferably formed by a plate which extends at least approximately tangentially to the fan wheel. The window is formed in the plate.

In a special configuration, a forward edge of the window is at a spacing to the forward edge of the plate. Further, it is seen to be practical that the rearward edge of the window is configured as a lip partitioning an air flow and the width of the window at the lip is five to twelve times the narrow width at the forward edge of the window. A combustion air channel is preferably formed in the housing element and this air channel extends from the window and is guided along the crankcase. Alternatively, it is also possible to configure the combustion air channel so that a channel can be connected to the combustion air channel in the fan cover. This channel, in turn, communicates with the air filter.

To improve the separator action still further, it is practical to provide an aerodynamically-shaped guide ramp ahead of the housing element in flow direction with this guide ramp rising in axial direction. This guide ramp is of special advantage when it is mounted as a flow sheathing or casing of an ignition coil in flow direction directly ahead of the ignition coil. The ignition coil projects into the interior space of the fan housing. In order to avoid air eddies behind the ignition coil, it is advantageous that a further guide ramp be provided in flow direction directly after the ignition coil. The housing element is preferably mounted, in flow direction, directly after the ignition coil in a flow cross section which is narrowed in correspondence to the first guide ramp. It is practical to form the additional guide ramp as one piece with the housing element. In this way, the number of components is reduced and the assembly is simplified.

BRIEF DESCRIPTION OF THE DRAWINGS

The invention will now be described with reference to the drawings wherein:

FIG. 3 shows the housing element of FIG. 2 as an individual part;

FIG. 4 is a perspective rearward view of the housing element of FIG. 3;

FIG. 5 is a schematic representation of the fan wheel with an ignition coil assigned thereto;

DESCRIPTION OF THE PREFERRED EMBODIMENTS OF THE INVENTION

Figure 1:
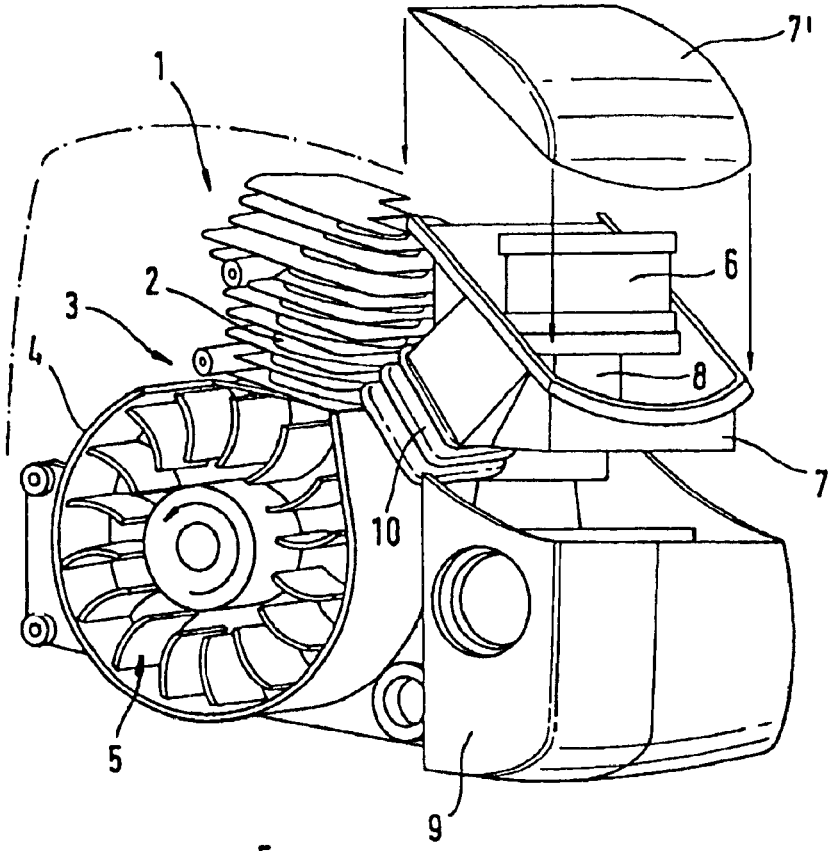
FIG. 1 is a schematic of an internal combustion engine equipped with a fan arrangement according to the invention.

FIG. 1 shows an internal combustion engine 1 having a cylinder 2 provided with cooling ribs. A radial fan arrangement 3 is provided for generating a cooling air flow and comprises a fan housing 4 and a fan wheel 5. An air filter 6 is provided in an air filter case (7, 7') for the combustion air. A carburetor 8 is connected to the air filter 6. A tank 9 for fuel is provided in a lower housing part. A connecting channel 10 extends from the fan housing 4 to the air filter case (7, 7') so that the combustion air is conducted from the fan housing 4 via the connecting channel 10 to the air filter 6.

Figure 2:
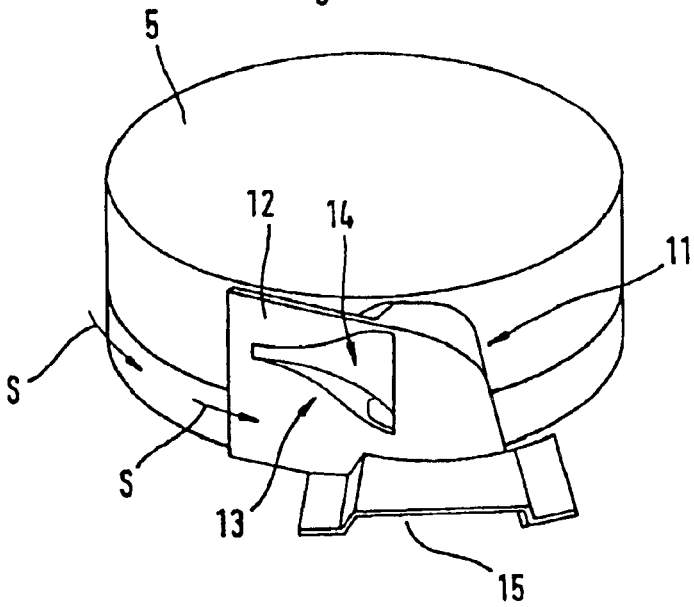
FIG. 2 is a perspective view of a first embodiment of a housing element having a take-out opening on a fan wheel.

FIG. 2 is a perspective view schematically showing the fan wheel 5 and a housing element 11 disposed at the periphery of the fan wheel. The housing element 11 functions as a separator for the combustion air. The housing element 11 is provided with a plate 12 wherein a take-out opening 13 is arranged for the combustion air. This take-out opening 13 includes a window 14 which is configured flat and narrow at the front end viewed in the flow direction indicated by arrow S and, in its further course in flow direction, the window increases with respect to its width and depth. The branched-off combustion air flow enters a combustion air channel 15 from the take-out opening 13. As shown in FIG. 2, the take-out opening 13, that is, the window 14 thereof, is on the side of the plate 12 of the housing element 11 facing away from the fan wheel 5.

In FIG. 3, the housing element 11, which defines the separator, is shown enlarged and as an individual part. The window 14 defining the take-out opening 13 is disposed in the plate 12 and has a small width (b) at a forward edge 17. The forward edge 17 is at a distance A from the forward edge 19 of the plate 12. Starting from this forward edge 17, the window increases in width as well as in depth and has a width B at a rearward edge 18. This width B at the rearward edge 18 is, for example, five times to twelve times the small width (b) at the forward edge 17. The contour of the window 14 is determined by diverging ramps 16. In the embodiment of FIG. 3, the ramps 16 are configured as two arcs. The combustion air channel 15 is configured to be flat and extends along the crankcase. Lateral brackets 23 lie against the channel 15.

As shown in FIGS. 3 and 4, the rearward boundary of the take-out opening 13 is defined by a back wall 20. The depth here is the distance of the back wall 20 from the plate 12 and, as shown, this depth increases when viewed in the flow direction S of the air. This depth is identified by reference character T in FIG. 4. FIG. 4 shows the housing element 11 from its rearward side, that is, the side facing toward the fan wheel. For the same parts, the reference numerals in FIG. 4 correspond to those in FIG. 3.

FIG. 5 shows a variation of the embodiment of FIG. 2 and, in FIG. 5, an ignition coil 24 is assigned to the fan wheel 5. A first guide ramp 21 is provided forward of the ignition coil 24 viewed in the flow direction S of the air. The guide ramp 21 is aerodynamically so configured that the air flow is deflected in the axial direction of the fan wheel 5. In this way, on the one hand, the dirt particles entrained in the air flow are guided in another direction than to the housing element 11 defining the separator. In contrast to the housing element shown in FIGS. 3 and 4, the housing element 11 in FIG. 5 is provided with a further guide ramp 22 which connects directly to the ignition coil 24 in order to substantially prevent air turbulence downstream of the ignition coil 24.

Figure 6:
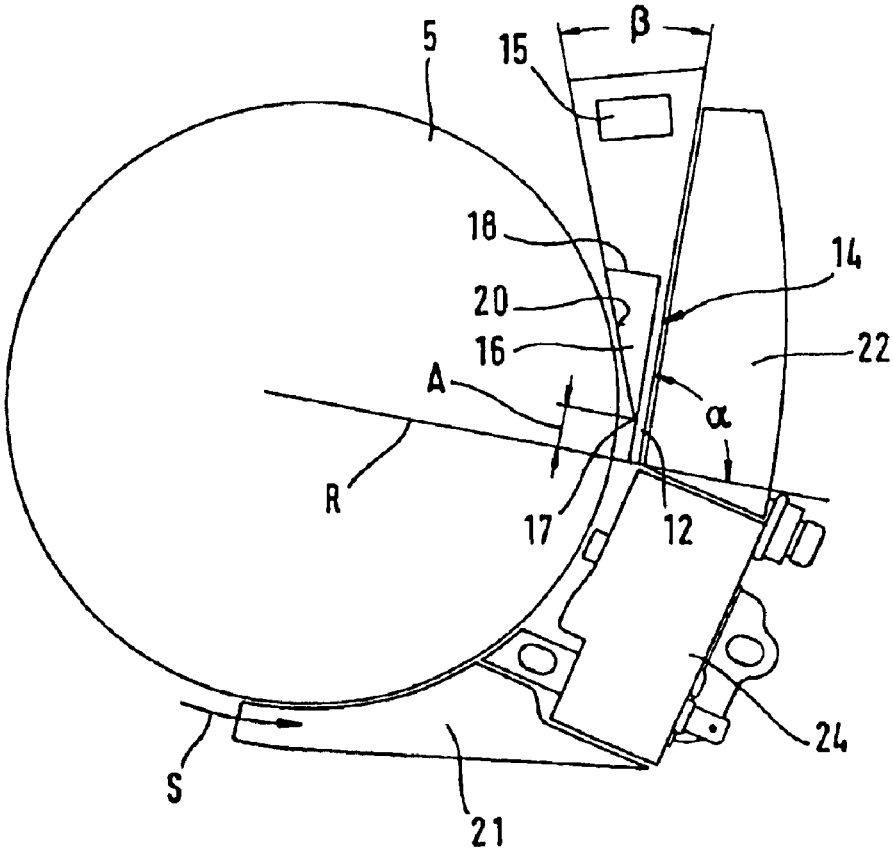
FIG. 6 is a plan view of the arrangement shown in FIG. 5.

FIG. 6 shows a plan view of the arrangement of FIG. 5. Viewed in flow direction S of the air, the first guide ramp 21 is forward of the ignition coil 24 and the additional guide ramp 22 is arranged downstream of the ignition coil 24. The guide ramp 22 can be configured as a separate component directly next to the housing element 11; however, it is practical to have a one-piece configuration. It is further shown in FIG. 6 that the rear wall 20 of the window 14 is arranged in the direct proximity of the periphery of the fan wheel 5. The plate 12 runs approximately tangentially to the fan wheel 5 and defines, for example, an angle $\alpha$ of 90° with the radial plane R of the fan wheel 5. The fact that the depth of the window 14 increases in the flow direction S of the air results from the course of the rear wall 20 referred to the plate 12. In the embodiment shown, the rear wall 20 runs, for example, at an angle $\beta$ of 20° to the plate 12. It is understood that the angles $\alpha$ and $\beta$ can also have other magnitudes in different embodiments and these angles are optimized and matched depending upon the work apparatus. The forward edge 17 as well as the rearward edge 18 and the ramp 16 are likewise shown in FIG. 6 with the ramp 16 becoming wider between the forward and rearward edges (17, 18). In the embodiment of FIG. 6, the combustion air channel 15 is so configured that its discharge opening is disposed at the upper end of the housing element 11. The combustion air is separated from the air flow generated by the fan wheel 5 and is conducted through a connecting channel from the combustion air channel 15 to the air filter 6.

Figure 7:
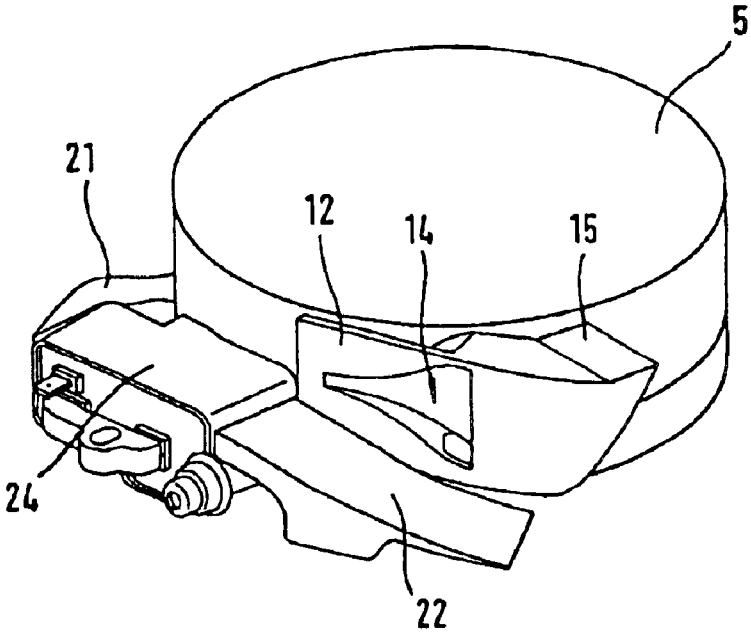
FIG. 7 shows the view of the arrangement of FIG. 5 rotated by 90° about the rotational axis of the fan wheel; and, FIG. 8 is an alternative configuration with respect to FIG. 7 shown enlarged.

FIG. 7 shows the arrangement of FIG. 5 rotated by 90° about the rotational axis of the fan wheel 5. For the same parts, the same reference numerals are used as those in FIG. 6. From this view, the contour of the additional guide ramp 22 as well as the discharge opening of the combustion air channel 15 can be seen.

Figure 8:
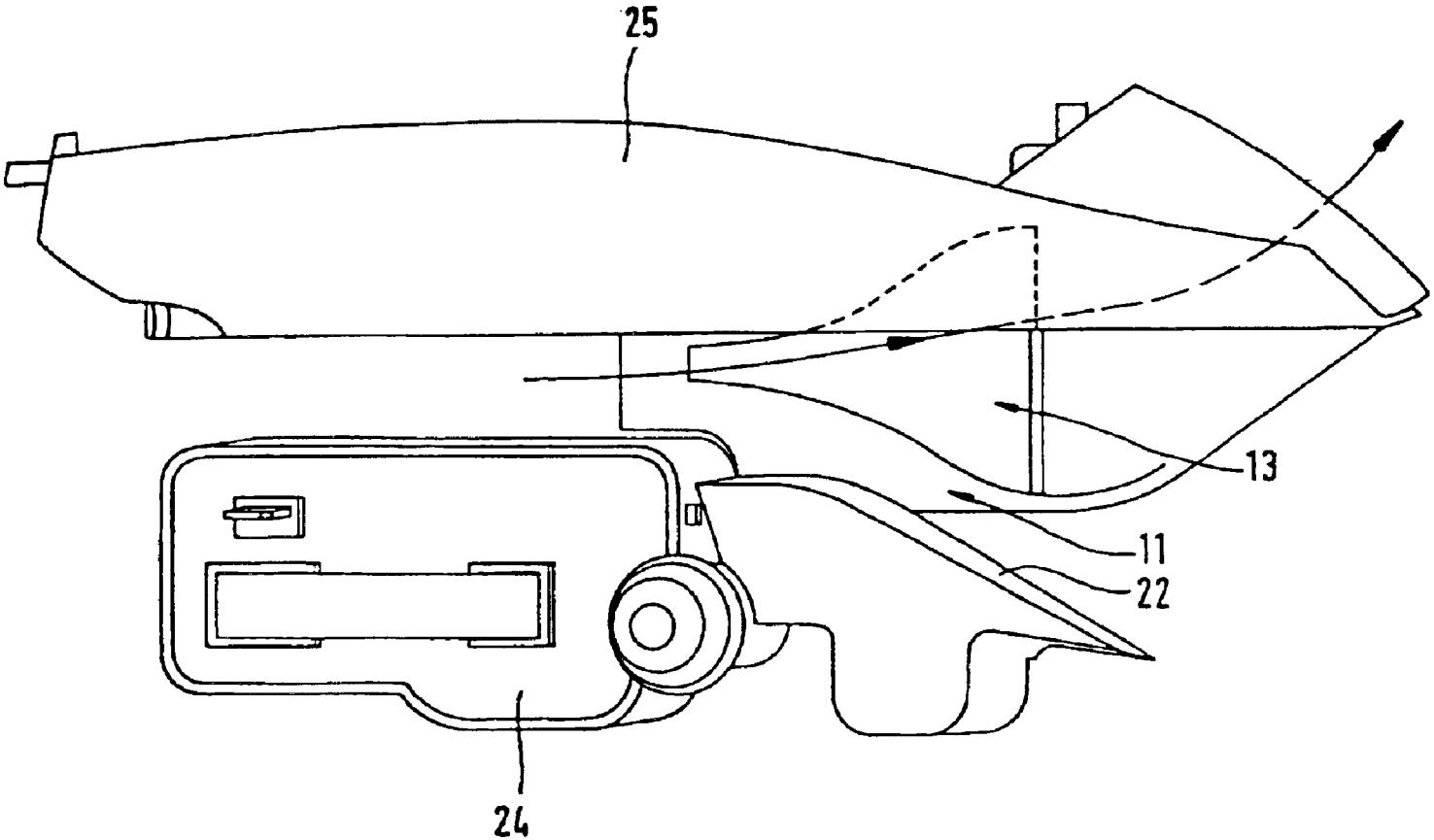

According to an alternate embodiment, it is also possible to mount a separator, which corresponds to the housing element, at the inner side of the fan cover (not shown). In an arrangement of this kind, the separator would be simultaneously mounted with the fan cover and, when the fan cover is removed, a better access is provided within the fan housing, for example, to the ignition coil. A configuration of this kind is shown in FIG. 8 wherein a segment 25 of a fan cover is shown above the ignition coil 24. At this segment, the housing element 11 is configured and the window 13 has a similar contour as in the FIGS. 2 to 7. The guide ramp 22 is mounted downstream of the ignition coil 24 in flow direction.

It is understood that the foregoing description is that of the preferred embodiments of the invention and that various changes and modifications may be made thereto without departing from the spirit and scope of the invention as defined in the appended claims.

What is claimed is:

1. A fan arrangement of an internal combustion engine including an engine of a portable handheld work apparatus, the fan arrangement comprising:

a fan wheel for acting on air to move said air in an air flow defining a flow direction (S);

a fan housing at least partially surrounding said fan wheel;

a take-out opening disposed in the region of said air flow to branch off a component of said air flow as a combustion air flow for said internal combustion engine;

said take-out opening being disposed outside of said fan wheel in radial direction;

said take-out opening being configured as a window having a forward edge viewed in said flow direction (S) and said forward edge having a small width (b); and, said window having a rearward edge and said window having a width and a depth which both increase toward said rearward edge.

2. The fan arrangement of claim 1, wherein said window is delimited by two ramps diverging in said flow direction (S).

3. The fan arrangement of claim 2, wherein said ramps have the form of two arcs.

4. The fan arrangement of claim 1, further comprising a housing element disposed next to said fan wheel and said housing element having a side facing away from said fan wheel;

and, said window being configured in said housing element and being arranged on said side facing away from said fan wheel.

5. The fan arrangement of claim 4, wherein said housing element includes a plate extending virtually tangentially to said fan wheel and said window is formed in said plate.

6. The fan arrangement of claim 5, wherein said plate has a forward end viewed in said flow direction and said forward edge of said window is at a distance (A) to said forward end of said plate.

7. The fan arrangement of claim 6, wherein said rearward edge of said window is configured as a lip partitioning said air flow and said window has a width (B) at said lip which is 5 times to 12 times said small width (b) at said forward edge.

8. The fan arrangement of claim 4, wherein said housing element has a combustion air channel formed therein and extending from said window.

9. The fan arrangement of claim 8, wherein said engine has a crankcase and said combustion air channel is configured to be flat and extend along said crankcase.

10. The fan arrangement of claim 4, wherein said fan housing includes a housing cover and said housing element is arranged on said housing cover so as to be mountable in common therewith.

11. The fan arrangement of claim 4, further comprising an aerodynamically formed guide ramp disposed forward of said housing element viewed in said flow direction (S) and said guide ramp rising in the axial direction of said fan wheel.

12. The fan arrangement of claim 11, wherein said engine includes an ignition coil projecting into said fan housing and said guide ramp is mounted directly forward of said ignition coil viewed in said flow direction (S) and said guide ramp is configured as a flow shroud for said ignition coil.

13. The fan arrangement of claim 12, wherein said guide ramp is a first guide ramp and wherein said fan arrangement further comprises a second guide ramp directly after said ignition coil viewed in said flow direction (S).

14. The fan arrangement of claim 13, said housing element being mounted directly after said ignition coil in a flow cross section narrowed in correspondence to said first guide ramp.

15. The fan arrangement of claim 13, wherein said second guide ramp is configured as one piece with said housing element.

16. The fan arrangement of claim 1, wherein said fan housing has a spiral shape.

* * * * *